US010029260B2

(12) United States Patent
King

(10) Patent No.: US 10,029,260 B2
(45) Date of Patent: Jul. 24, 2018

(54) CENTRIFUGE TUBE HOLDING ASSEMBLY

(71) Applicant: Taj King, Orange Park, FL (US)

(72) Inventor: Taj King, Orange Park, FL (US)

( * ) Notice: Subject to any disclaimer, the term of this patent is extended or adjusted under 35 U.S.C. 154(b) by 70 days.

(21) Appl. No.: 15/162,837

(22) Filed: May 24, 2016

(65) Prior Publication Data

US 2017/0341079 A1 Nov. 30, 2017

(51) Int. Cl.
*B01L 9/06* (2006.01)
*B04B 15/00* (2006.01)

(52) U.S. Cl.
CPC ..... *B01L 9/06* (2013.01); *B04B 15/00* (2013.01); *B01L 2200/025* (2013.01); *B01L 2200/087* (2013.01); *B01L 2300/0809* (2013.01); *B01L 2300/0848* (2013.01); *B01L 2300/12* (2013.01); *B01L 2300/1894* (2013.01)

(58) Field of Classification Search
None
See application file for complete search history.

(56) References Cited

U.S. PATENT DOCUMENTS 2,741,913 A * 4/1956 Dovas ..... B01L 9/06 68/205 R
3,186,556 A * 6/1965 Forsstrom ..... B01L 9/06 211/74
3,271,112 A 9/1966 Williams
3,607,134 A 9/1971 McIntyre
3,674,198 A * 7/1972 Eberle ..... B04B 5/04 211/74
4,124,122 A * 11/1978 Emmitt ..... B01L 9/06 211/74
5,446,263 A 8/1995 Eigen et al.
5,616,301 A 4/1997 Moser et al.
5,720,377 A * 2/1998 Lapeus ..... B01L 9/06 198/346.1
D428,497 S 7/2000 Lapcus et al.
2008/0075634 A1* 3/2008 Herchenbach ..... B01L 9/06 422/400
2010/0043572 A1* 2/2010 Himmelsbach ..... B01L 3/50825 73/863.11
2012/0009104 A1 1/2012 Bolotin et al.

FOREIGN PATENT DOCUMENTS

WO WO2015010590 1/2015

* cited by examiner

*Primary Examiner* — Paul S Hyun

(57) ABSTRACT

A centrifuge tube holding assembly includes a body having a front side, a back side, a top edge, a bottom edge, a first lateral edge and a second lateral edge. The top edge has a plurality of apertures extending downwardly therein and each of the apertures may be used for removably receiving an ultracentrifuge tube. The front wall has an opening therein for viewing an open space positioned below the top edge. A panel is positioned over the opening. The panel is transparent to allow viewing through the panel.
The panel has measurement indicia thereon configured to be positioned to be alignable with the ultracentrifuge tube.

8 Claims, 4 Drawing Sheets

CENTRIFUGE TUBE HOLDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to tube holding devices and more particularly pertains to a new tube holding device for holding tubes, and in particular ultracentrifuge tubes requiring a high degree of accuracy while preparing sucrose gradients.

BRIEF SUMMARY OF THE INVENTION

An embodiment of the disclosure meets the needs presented above by generally comprising a body having a front side, a back side, a top edge, a bottom edge, a first lateral edge and a second lateral edge. The top edge has a plurality of apertures extending downwardly therein and each of the apertures may be used for removably receiving an ultracentrifuge tube. The front wall has an opening therein for viewing an open space positioned below the top edge. A panel is positioned over the opening. The panel is transparent to allow viewing through the panel. The panel has measurement indicia thereon configured to be positioned to be alignable with the ultracentrifuge tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
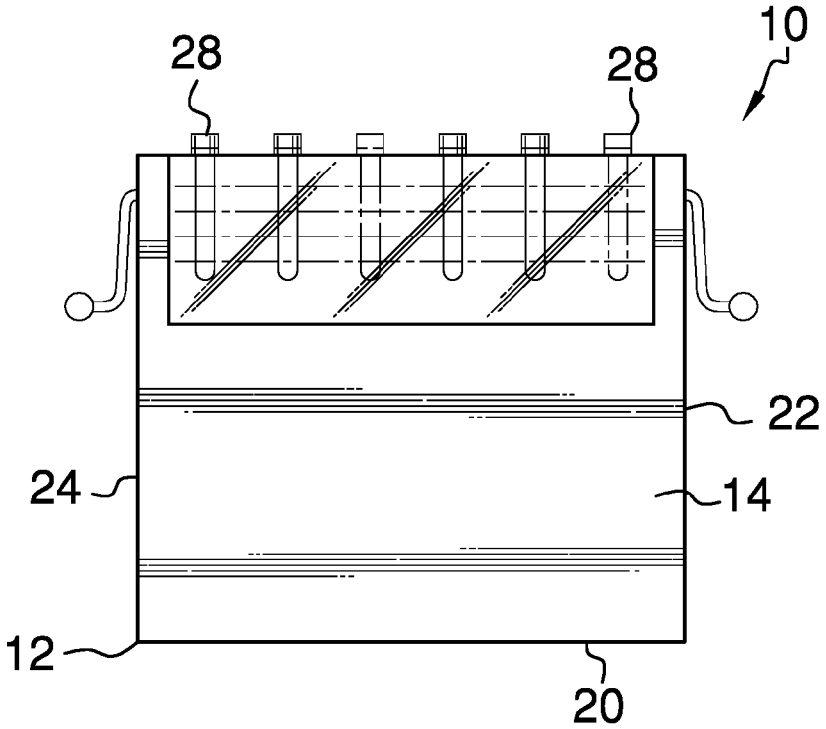
FIG. 1 is a front view of a centrifuge tube holding assembly according to an embodiment of the disclosure.
Figure 2:
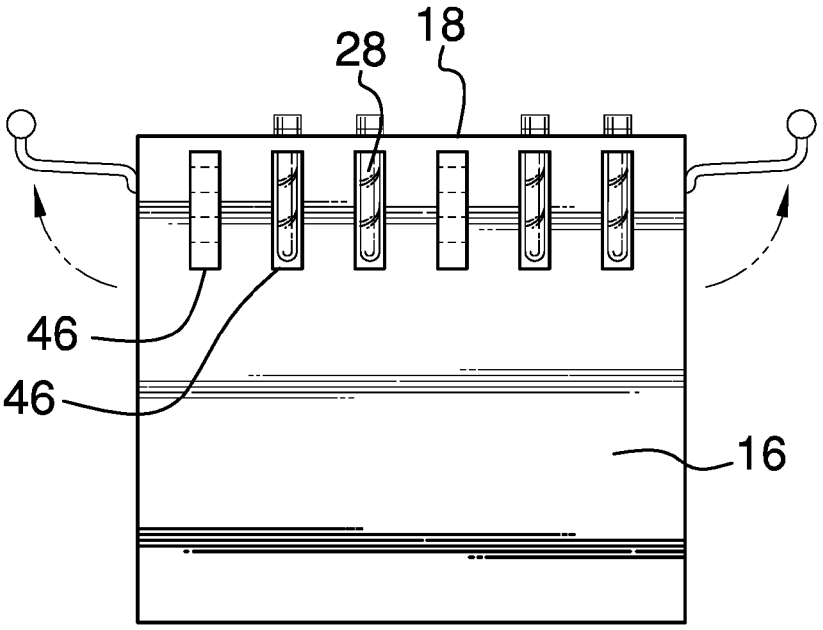
FIG. 2 is a rear view of an embodiment of the disclosure.
Figure 3:
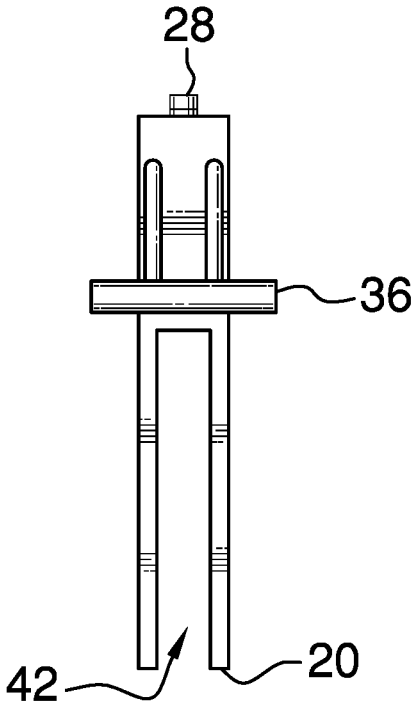
FIG. 3 is a side view of an embodiment of the disclosure.
Figure 4:
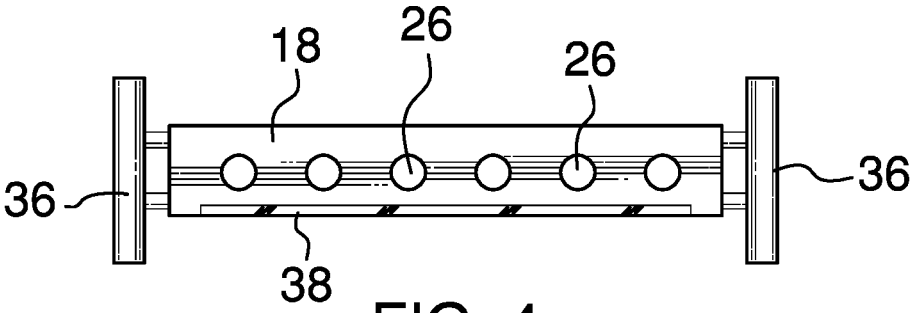
FIG. 4 is a top view of an embodiment of the disclosure.
Figure 5:
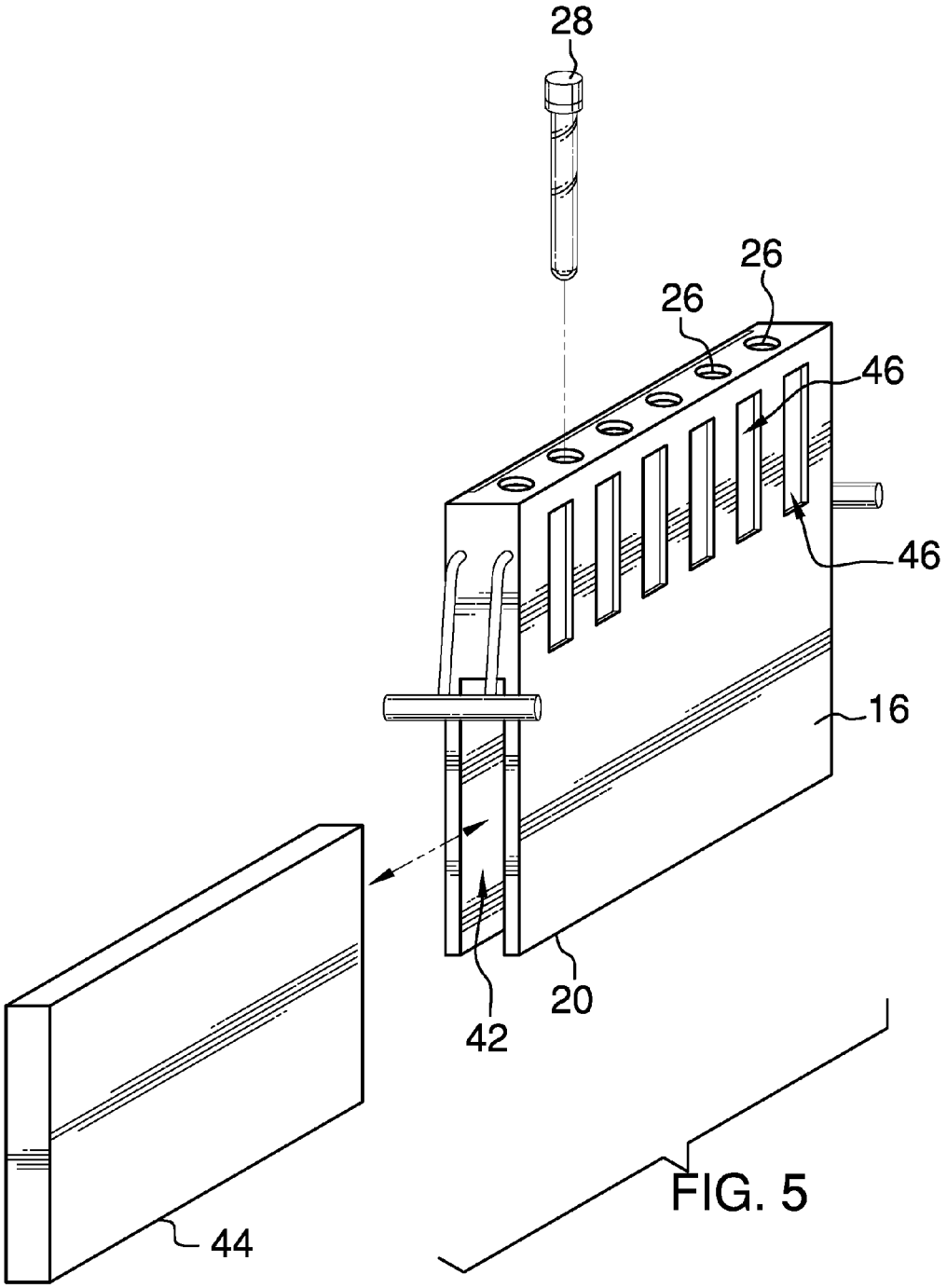
FIG. 5 is a rear and right side perspective view of an embodiment of the disclosure.
Figure 6:
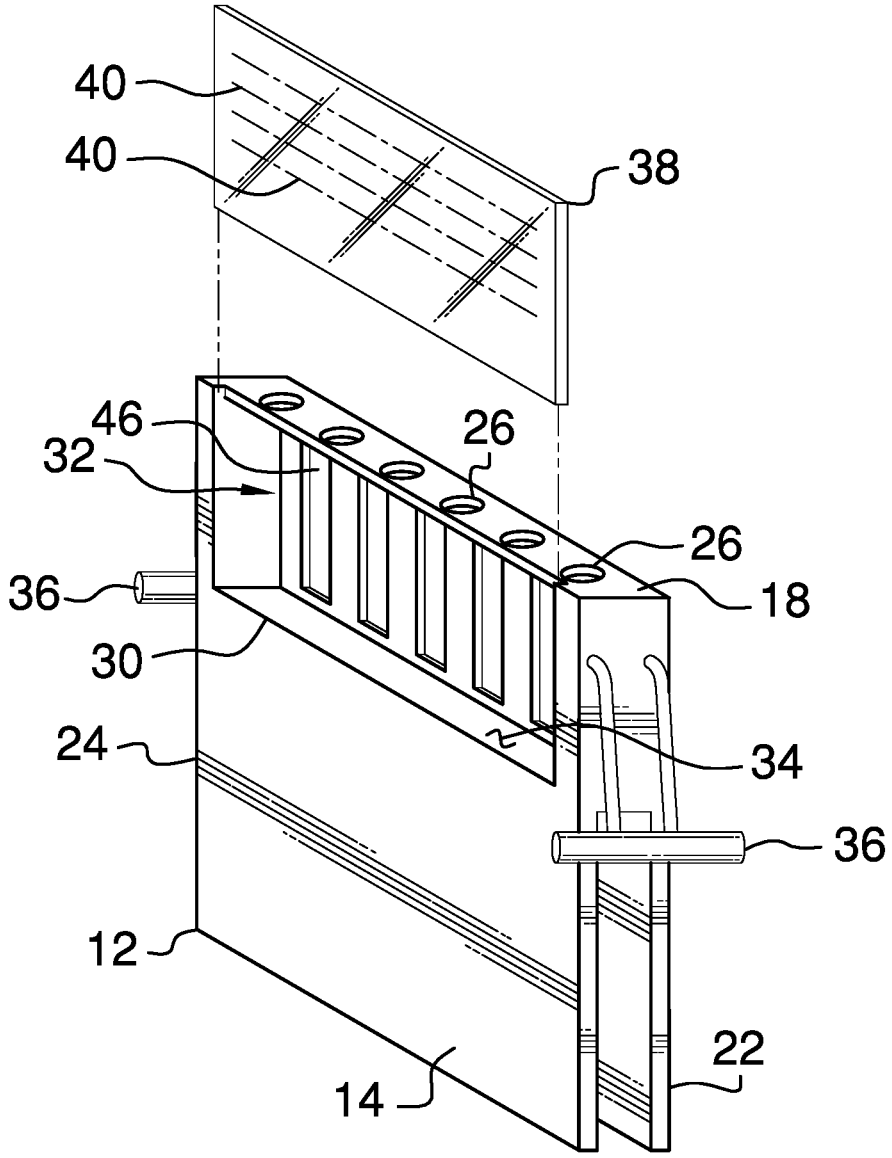
FIG. 6 is a front and right side perspective view of an embodiment of the disclosure.

With reference now to the drawings, and in particular to FIGS. 1 through 6 thereof, a new tube holding device embodying the principles and concepts of an embodiment of the disclosure and generally designated by the reference numeral 10 will be described.

As best illustrated in FIGS. 1 through 6, the centrifuge tube holding assembly 10 generally comprises a body 12 having a front side 14, a back side 16, a top edge 18, a bottom edge 20, a first lateral edge 22 and a second lateral edge 24. The body 12 may be a unitary body formed of a single molded piece of material. The top edge 18 has a plurality of apertures 26 extending downwardly therein. Each of the apertures 26 is adapted for removably receiving an ultracentrifuge tube or microfuge tube such that the tubes 28 are held in a vertical orientation. The front side 14 has an opening 30 therein for viewing an open space 32 positioned below the top edge 18. The open space 32 includes a bottom wall 34 against which the tubes 28 may be rested if they do not include a lip for engaging the top edge 18 of the body 12. The body 12 may be comprised of a thermally conductive material and more particularly the thermally conductive material may comprise a metallic material. Thus, the body 12 may be cooled, such as by placing it in a refrigeration unit, to help retain samples in the tubes 28 at cooled temperature. A pair of handles 36 may be attached to the body 12. Each of the first 22 and second 24 lateral edges has one of the handles 36 attached thereto.

A panel 38 is positioned over the opening 30 and is transparent to allow viewing through the panel 38. The panel 38 may be comprised of a plastic or glass material. The panel 38 has measurement indicia 40 thereon configured to be positioned to be alignable with the ultracentrifuge or microfuge tubes 28. The measurement indicia 40 may be provided in whatever units or volumes most well suited to the particular usage of the assembly 10. The measurement indicia 40 allows a user of the assembly 10 to accurately add fluids, typically by pipette, to the tubes without the user needing to hold the tube 28 and pipette at the same time. This will increase accuracy during the transfer of materials. The measurement indicia 40 will typically be formed of a plurality of horizontal lines indicating different volumes depending on the size and types of tubes 28 being utilized. The panel 38 may be removed and replaced depending on the required measurement indicia 40.

The bottom edge 20 may have a slot 42 extending upwardly therein. The slot 42 is configured to receive a cooling pack 44. The cooling pack 44 may be used instead of or in addition to refrigeration to retain the body 12 in a cooled state. The slot 42 extends through the first 22 and second 24 lateral edges.

A plurality of access slots 46 extends through the back side 16 and into the open space 32. Each of the access slots 46 is positioned to be aligned with an axis of one of the apertures 26. The access slots 46 allow for access to the tubes 28, such as after untracentrifugation, so that a syringe may inserted into the tubes 28 while positioned in the body 12 to extract virus particles and the like without risk of accidental needle pricks to the user's hands.

In use, the assembly 10 allows for very efficient and fast loading and accurate measurement of liquids which are dispensed into ultracentrifuge/mircrofuge tubes 28 while retaining the tubes 28 in a cooled and upright condition. Additionally, the body 12 will allow for easy and safe extraction of particles from the tubes as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A holder assembly for ultracentrifuge tubes comprising:

a body having a front side, a back side, a top edge, a bottom edge, a first lateral edge and a second lateral edge, said top edge having a plurality of apertures extending downwardly therein, each of said apertures being adapted for removably receiving an ultracentrifuge tube, said front side having an opening therein for viewing an open space positioned below said top edge, a panel being positioned over said opening, said panel being transparent to allow viewing through said panel, said panel having measurement indicia thereon configured to be positioned to be alignable with each ultracentrifuge tube; and a plurality of access slots extending through said back side and into said open space, each of said access slots being positioned in alignment with an axis of one of said apertures.

2. The holder assembly for ultracentrifuge tubes according to claim 1, wherein said body is comprised of a thermally conductive material.

3. The holder assembly for ultracentrifuge tubes according to claim 2, said thermally conductive material comprises a metallic material.

4. The holder assembly for ultracentrifuge tubes according to claim 1, wherein said bottom edge has a slot extending upwardly therein, said slot being configured to receive a cooling pack.

5. The holder assembly for ultracentrifuge tubes according to claim 4, wherein said slot extends through said first and second lateral edges.

6. The holder assembly for ultracentrifuge tubes according to claim 1, further including a pair of handles being attached to said body.

7. The holder assembly for ultracentrifuge tubes according to claim 6, wherein each of said first and second lateral edges has one of said handles attached thereto.

8. A holder assembly for ultracentrifuge tubes comprising:

a body having a front side, a back side, a top edge, a bottom edge, a first lateral edge and a second lateral edge, said top edge having a plurality of apertures extending downwardly therein, each of said apertures being adapted for removably receiving an ultracentrifuge tube, said front side having an opening therein for viewing an open space positioned below said top edge, a panel being positioned over said opening, said panel being transparent to allow viewing through said panel, said panel having measurement indicia thereon configured to be positioned to be alignable with each ultracentrifuge tube;

said body being comprised of a thermally conductive material, said thermally conductive material comprising a metallic material;

said bottom edge having a slot extending upwardly therein, said slot being configured to receive a cooling pack, said slot extending through said first and second lateral edges;

a plurality of access slots extending through said back side and into said open space, each of said access slots being positioned in alignment with an axis of one of said apertures; and a pair of handles being attached to said body, each of said first and second lateral edges having one of said handles attached thereto.

* * * * *